US005922140A

United States Patent [19]

Wills

[11] Patent Number: 5,922,140

[45] **Date of Patent: *Jul. 13, 1999**

[54] SELF-WRINGING ABSORBENT DEVICE OPERABLE WITH ONE HAND

[75] Inventor: Harry Allen Wills, Novato, Calif.

[73] Assignee: Thomas Joseph Neff, Novato, Calif.

[21] Appl. No.: 09/170,373

[22] Filed: Oct. 13, 1998

Related U.S. Application Data

[60] Provisional application No. 60/061,939, Oct. 14, 1997.

[51] Int. Cl.[6] ..... A47L 13/14; A47L 13/146; B08B 7/00

[52] U.S. Cl. ..... 134/6; 15/119.2; 15/118

[58] Field of Search ..... 15/119.2, 119.1, 15/116.1, 116.2, 118, 228; 134/6

[56] References Cited

U.S. PATENT DOCUMENTS

| | | | |
|---|---|---|---|
| 2,203,106 | 6/1940 | Rogers | 15/119.2 |
| 2,741,787 | 4/1956 | Palma, Jr. et al. | 15/119.2 |
| 2,892,201 | 6/1959 | Peterson et al. | 15/119.2 |
| 3,006,010 | 10/1961 | O'Rorke | 15/119.2 |
| 3,727,259 | 4/1973 | Wilson | 15/119.2 |
| 4,196,488 | 4/1980 | Barry | 15/119.2 |
| 4,333,198 | 6/1982 | Vosbikian | 15/119.2 |
| 4,481,688 | 11/1984 | Graham | 15/119.2 |
| 4,893,369 | 1/1990 | Johnson | 15/119.2 |

FOREIGN PATENT DOCUMENTS

| | | | |
|---|---|---|---|
| 767342 | 9/1967 | Canada | 15/119.2 |
| 1537262 | 8/1968 | France | 15/119.2 |

*Primary Examiner*—Gary K. Graham
*Attorney, Agent, or Firm*—Jack Lo

[57] ABSTRACT

A self-wringing absorbent device includes a handle (10) with a pair of brackets (12) extending from opposite ends. Each bracket terminates in an archway (16). The brackets are connected on opposite sides by first and second bases (14). A retraction bar (22) is mounted between the brackets for slidable movement towards and away from the handle. The retraction bar is mounted to a hinged platen (28) against which the bases bear and in which the hinge (30) is aligned with and substantially centered under the two archways. When the retraction bar is drawn towards the handle by the action of the fingers of the hand grasping the handle, the hinge of the platen is drawn upwards, the bases bear against the sides of the platen forcing them to fold about the hinge and be drawn into the archways, compressing a pad mounted to the platen. In an alternative embodiment, the absorbent device includes flared ends (43) on the brackets (42) extending from the handle (40). The outer portions of a pair of lateral platens (54) ride in guide rails (45) on the flared ends of the brackets. The inner portions of the platens are hinged to a retraction bar (49) slidable between the brackets. When the retraction bar is drawn toward the handle, the outer portions of the platens are guided toward each other by the rails, and the pads (60) attached to the platens are compressed against each other.

23 Claims, 3 Drawing Sheets

SELF-WRINGING ABSORBENT DEVICE OPERABLE WITH ONE HAND

CROSS REFERENCE TO RELATED APPLICATION

The subject matter disclosed herein was disclosed in provisional application No. 60/061,939, filed Oct. 14, 1997.

FIELD OF THE INVENTION

The present invention relates to the field of hand-operated absorbent devices.

BACKGROUND OF THE INVENTION

It is well-known to incorporate sponges and other compressible cleaning materials into cleaning implements for cleaning floors, walls, and other surfaces. Sponges and other pads absorb cleaning fluids, spilled fluids and the like until the carrying capacity of the material is reached. When that occurs, fluids are no longer absorbed, can be and often are undesirably redeposited on the surface to be cleaned, thus necessitating the removal of excess fluids from the pad. This is typically done by compressing the pad to expel the excess fluids.

Many conventional cleaning implements therefore include a means for compressing the pad and removing excess fluids. However, such conventional means typically require two hands to operate. For example, U.S. Pat. No. 3,727,259 to Wilson describes a mop which is held in one hand while a lever is pulled up by another hand to draw a sponge head having a biconvex cross-section through a pair of rollers to compress the sponge and expel excess fluid. Similar devices are disclosed in U.S. Pat. Nos. 4,196,488 to Barry, 4,333,198 to Vosbikian, and 4,481,688 to Graham.

Conventional hand-held cleaning implements are difficult to operate with a single hand, or are not usable for a wide variety of cleaning tasks. For example, the cleaning device disclosed in U.S. Pat. No. 4,893,369 to Johnson requires two hands to wring. That disclosed in U.S. Pat. No. 2,741,787 may permit the user to wring the device with a single hand, but is intended for cleaning dishes and would not be suitable for other tasks, such as cleaning floors or counters.

SUMMARY OF THE INVENTION

The present invention provides a self-wringing absorbent device having a rigid handle mounted at one end to a first bracket, and at the other end to a second bracket. Each bracket terminates in an archway, the archways being aligned with each other and connected on one side by a first base and on another side by a second base. A movable retraction bar is mounted between the first and second brackets for slidable movement towards and away from the rigid handle. A slot can be provided between the handle and the archway on each bracket for mounting the retraction bar. Mounted to the retraction bar is a hinged platen which is aligned with and substantially centered under the two archways. A compressible absorbent pad is attached to the platen for absorbing liquid. When the retraction bar is in the normal, down position, the platen is substantially flat. When the retraction bar is drawn towards the handle by the action of the fingers of the hand grasping the handle, the platen is drawn upwards and into the archways, causing the platen to fold, compressing the absorbent pad to wring out the liquid. The pad can be attached to the platen using conventional means, or a pressure-sensitive adhesive can be used which has release characteristics which permits pads to be removed and replaced as desired. In an alternative embodiment, the absorbent device includes flared ends on the brackets extending from the handle. The outer portions of a pair of lateral platens ride in guide rails on the flared ends of the brackets. The inner portions of the platens are hinged to a retraction bar slidable between the brackets. When the retraction bar is drawn toward the handle, the outer portions of the platens are guided toward each other by the rails, and the pads attached to the platens are compressed against each other. The present self-wringing absorbent device is thus simple in design, and is easy to wring with a single hand.

DETAILED DESCRIPTION OF THE INVENTION

Figure 1:
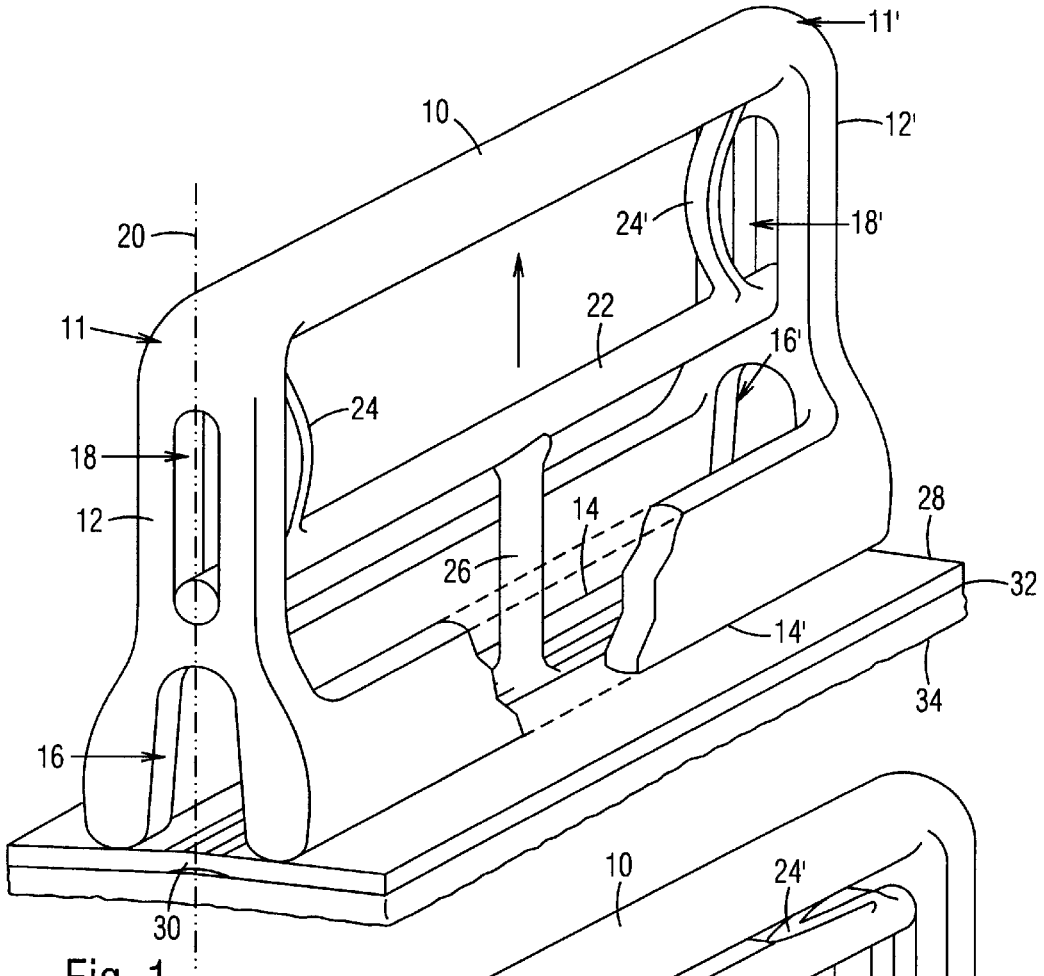
FIG. 1 provides a partially cutaway, perspective view of the present self-wringing absorbent device with the platen in the normal, fully extended, absorbing position.

As shown in FIG. 1, the present self-wringing absorbent device includes a handle 10 having a first end 11 and a second end 11'. Handle 10 is preferably shaped to be comfortably gripped by a user while using the device. Attached to the first end 11 is a first bracket 12, and attached to the second end 11' is a second bracket 12'. Brackets 12, 12' extend away from the handle 10 and terminate in archways 16, 16' Brackets 12, 12' can be oriented with respect to each other so as to be substantially parallel to each other, or, alternatively, they can incline slightly towards or away from each other as they extend away from handle 10.

A first base 14 connects a first side of archways 16, 16' to each other and a second base 14' connects the second side of archways 16, 16' to each other. Handle 10, brackets 12, 12' and bases 14, 14' are intended to form together a rigid framework, and can be constructed from any material which is substantially rigid, durable, and suitable for the absorbent device, such as, for example, plastic, wood or steel. Preferably, handle 10, brackets 12, 12' and bases 14, 14' are "integrally formed" that is, formed from a single piece, such as, for example, by machining wood or metal, casting metal, or molding plastic.

Brackets 12, 12' can be provided with a slot, 18, 18' respectively, which face and are aligned with each other. While the slots are preferably cut through both sides of the brackets 12, 12', it would be possible to use blind slots open only on the side of each bracket 12, 12' facing the other bracket. As shown in the Figures, slot 18 is preferably positioned along an axis 20 which bisects the archway 16, so that a longitudinal central axis of slot 18 coincides with bisecting axis 20. Slot 18', which is preferably aligned with slot 18, would thus be identically positioned with respect to its archway 16'. The slots 18, 18' are provided for mounting retraction bar 22.

Retraction bar 22 is mounted for movement towards and away from handle 10 preferably by inserting one end into slot 18 and an opposite end into slot 18'. This method limits the permissible travel of retraction bar 22 from the bottom to the top of slots 18, 18'. Mounting arm 26 is attached at one end to retraction bar 22 and at the other end to platen 28. Most preferably, mounting arm 26 is a single arm mounted at one end to the center of retraction bar 22 and at its other end to a center of platen 28; however, mounting arm 26 could also be a plurality of bars mounted along retraction bar 22 to evenly transmit the force from retraction bar 22 to the top of platen 28.

Platen 28 is preferably formed from a generally rectangular plate divided by a hinge 30. Preferably included is one or more springs 24, 24' for biasing the retraction bar 22 away from the handle 10. Retraction bar 22 and mounting arm 26 are intended to form together a single, rigid member. Platen 28 is, likewise, intended to form with retraction bar 22 and mounting arm 26 a rigid member which will hinge about hinge 30. Thus, when the retraction bar is drawn towards the handle 10 and the hinge 30 follows, the top surface of the platen 28 will bear against the bases 14,14' forcing the platen 28 to fold along hinge 30 and be drawn into the archways 16, 16.' Retraction bar 22, mounting arm 26, and platen 28 can be formed from any suitable substantially rigid and durable material, such as wood, plastic, or steel. Most preferably, retraction bar 22, mounting arm 26, and platen 28 are integrally formed of plastic, and wherein platen 28 is provided with an integral "living hinge" formed by thinning and/or scoring the plastic in the area where the hinging is to occur.

Attached to platen 28 is a pad 34 which can be formed from any suitable compressible absorbent material, such as natural or synthetic sponge, fabric, woven and non-woven fibers, fibrous abrasives such as 3M Corporation's SCOTCHBRITE® abrasive pads, chamois, steel wool, or a combination thereof (such as, for example, a sponge with a layer of fibrous abrasive on one side). Pad 34 is preferably formed of a shape to conform to the shape of platen 28, and is constructed of an even thickness (e.g., so that the thickness of the pad is substantially the same no matter where it is measured. This even thickness of the pad is an important feature which provides, in combination with the width of the hinge and the width of the archways, even compression when the platen 28 is folded along hinge 30, to enable easy expulsion of excess fluid from the pad 34.

Pad 34 can be permanently attached, for example, by adhesive, to platen 28. However, when pad 34 wears out, the device would have to be thrown away. Accordingly, it is preferred to removably attach the pad 34 to the platen 28 to provide a device with a longer useful lifetime. Pad 34 can be removably attached by conventional means (e.g., using mechanical fasteners such as clips, screws, and the like). Alternatively, pad 34 can be removably attached to the platen 28 using a layer of pressure-sensitive adhesive 32 which is substantially unaffected by repeated immersion in water, and which has release characteristics which permit the repeated removal and replacement of the pad 34.

Springs 24, 24' can be used to bias the retraction bar 22 away from handle 10. Leaf springs, as shown in the figures, which are positioned between handle 10 and retraction bar 22 are preferred. However, one skilled in the art will recognize that it would be possible to use many other kinds of springs, positioned in many other ways to bias retraction bar 22 away from handle 10. For example, coiled springs could be positioned between bases 14, 14' and retraction bar 22 to bias retraction bar 22 towards bases 14, 14' and away from handle 10. Springs 24, 24' can be produced from any suitable material such as, for example, plastic or metal. Most preferably, springs 24, 24' are integrally formed with retractor bar 22, mounting arm 26, and platen 28 of plastic.

As can be appreciated by one having skill in the art, the dimensions of the slots, archways, springs, platen and the like will depend upon the desired size of the utensil. For example, the width of slots 18, 18' will depend upon the diameter or cross-section dimension of the retraction bar 22. The length of slots 18, 18' and springs 24, 24' and height of archways 16, 16' will depend upon the distance the retraction bar must travel to completely fold the platen 28 along hinge 30. The width of hinge 30 and archways 16, 16' will depend upon the thickness of pad 34 and the degree of compression desired.

Figure 2:
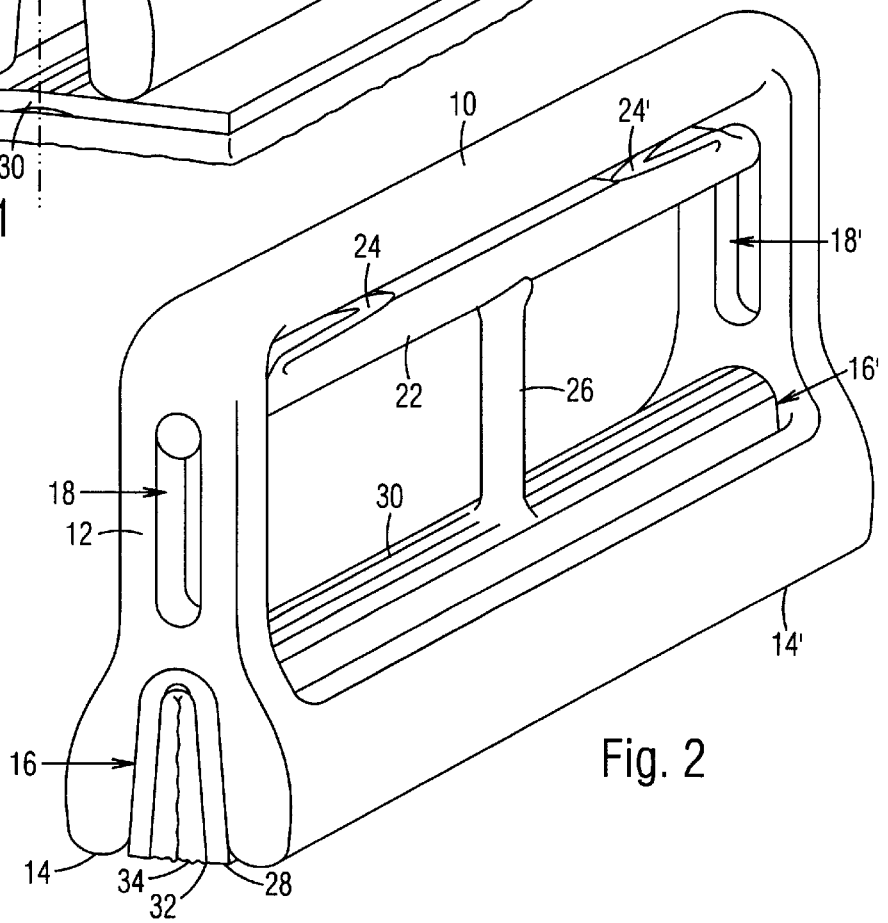
FIG. 2 provides a perspective view of the device in FIG. 1, in which the platen is folded along the hinge and drawn into the wringing position by pulling the retraction bar towards the handle.

To use the device as shown in FIG. 1, a user grasps the handle 10 with a hand, picks the device up and places the pad 34 in a fluid. The fluid may be cleaning fluid (such as, for example, a soap solution) which the user wishes to use to wet the pad and apply to a surface to be cleaned, or the fluid may be waste fluid to be cleaned from a surface. When pad 34 has reached its maximum holding capacity—that is, it has absorbed all of the fluid it is capable of absorbing, the user can wring excess fluid out of the pad by engaging the retractor bar 22 with one or more fingers. As the retractor bar 22 is drawn towards the handle 10, the hinge 30 follows and the top surface of the platen 28 on both sides of the hinge 30 bears against the bases 14, 14'. This causes the platen 28 to fold at the hinge 30. As the folding platen 28 is drawn into the archways 16, 16', the pad is compressed against itself, expelling excess fluid. In the fully retracted position, as shown in FIG. 2, the springs 24, 24' are fully compressed, the retraction bar 22 is adjacent the handle 10 and is positioned in slots 18, 18' at the end closest to the handle 10, the platen 28 is folded along hinge 30 and is drawn fully into archways 16, 16', and the pad 34 is compressed. When retraction bar 22 is released, the springs 24, 24' automatically force the retraction bar 22 away from handle 10 (positioning it in the end of slots 18, 18' at the end furthest away from handle 10), returning the device to the orientation as depicted in FIG. 1. When the user applies the pad 34 to a surface to be cleaned, the pressure applied to handle 10 is transmitted through brackets 12, 12' to bases 14, 14' which bear against the top of platen 28, effectively compressing pad 34 against the surface to be scrubbed.

Figure 3:
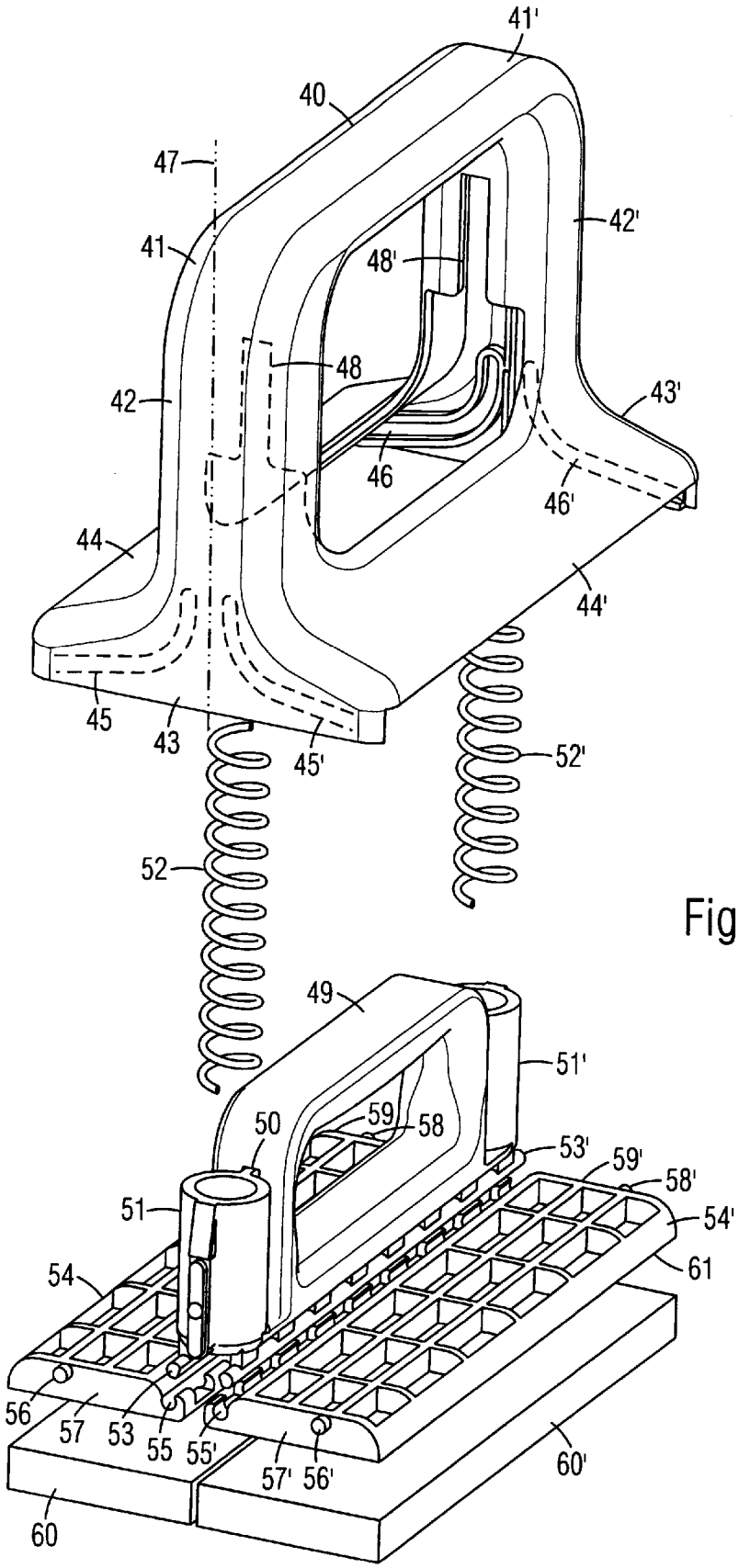
FIG. 3 provides a perspective exploded view of an alternative embodiment of the self-wringing absorbent device.

As shown in FIG. 3, an alternative embodiment of the present invention includes a handle 40 with a first end 41 and a second end 41'. A first bracket 42 and a second bracket 42' extend away respectively from first end 41 and second end 41', and terminate in a first flared end 43 and a second flared end 43'. Brackets 42 and 42' are preferably hollow. A first base 44 connects a first side of flared ends 43, 43' to each other, and a second base 44' connects the second side of flared ends 43, 43' to each other. A first pair of curved guide rails 45, 45' are arranged on the interior of flared end 43, and a second pair of curved guide rails 46, 46' are arranged on the interior of flared end 43'. Each pair of guide rails is generally symmetrical about a central axis 47 that bisects bracket 42. The guide rails in each pair are curved from inner ends which are generally parallel to axis 47, to outer ends that extend outwardly away from each other in generally opposite directions. A first slot 48 and a second slot 48' are respectively arranged on the inner sides of brackets 42, 42'.

A retraction bar 49 is preferably in the shape of an open frame, although it may be in other shapes. First and second guide tabs 50 (one shown) are attached to opposite ends of retraction bar 49 for movably positioning in slots 48, 48'.

Retraction bar 49 includes a first spring retainer 51 and a second spring retainer 51' at opposite ends thereof. A first compression spring 52 and a second compression spring 52' are for being positioned within brackets 42, 42', and between first and second ends 41, 41' of handle 40, and spring retainers 51, 51' of retraction bar 49. Alternatively, other types of springs can be provided and attached to retraction bar 49 in other arrangements. A pair of parallel hinge rods 53 and 53' extend along the lower edge of retraction bar 49. A first platen 54 and a second platen 54' respectively include a first groove 55 and a second groove 55' for pivotally mating with hinge rods 53, 53'. Alternatively, platens 54, 54' may be hinged to retraction bar 49 in other ways, such as with living hinges. A first pair of pins 56, 56' extend respectively from first ends 57, 57' of platens 54, 54' for engaging guide rails 45, 45', and a second pair of pins 58, 58' extend from second ends 59, 59' of platens 54, 54' for engaging guide rails 46, 46'. A first compressible pad 60 and a second compressible pad 60', such as sponges, are attached to the bottoms of platens 54, 54', preferably with adhesive 61. Alternatively, a single pad can be attached across both platens 54, 54'.

Figure 4:
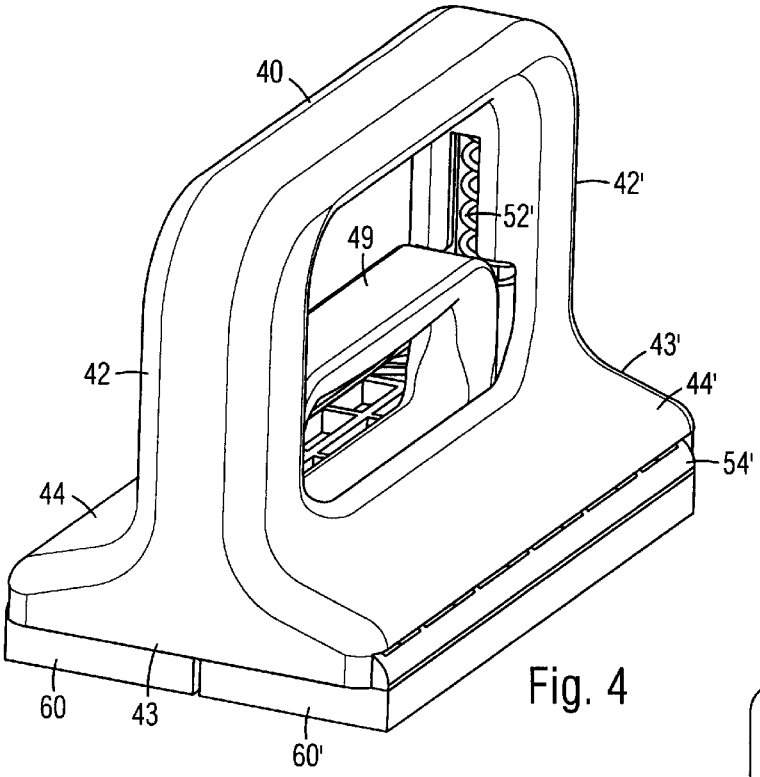
FIG. 4 provides a perspective view of the device of FIG. 3 assembled, with the platens in the normal, fully extended, absorbing position.
Figure 5:
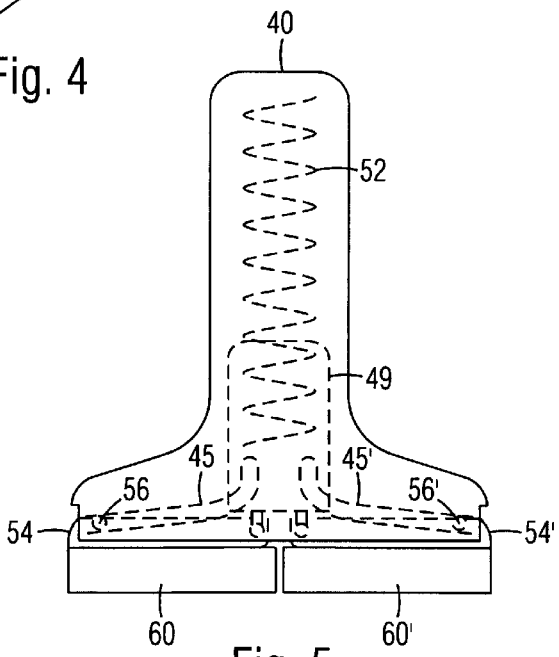
FIG. 5 provides a side view of the device of FIG. 4.

The device of FIG. 3 is shown assembled in FIGS. 4 and 5. Retraction bar 49 is positioned between bases 44, 44', and between brackets 42, 42'. Springs 52, 52' are slightly compressed between handle 40 retraction bar 49. Pins 56, 56' and 58, 58' (not shown) are respectively positioned at the outer ends of guide rails 45, 45' and 46, 46' (not shown). Pads 60, 60' are in a coplanar, fully extended position lateral to each other, and outside flared ends 43, 43' of brackets 42, 42'. The device is thus usable for rubbing surfaces with pads 60, 60'.

Figure 6:
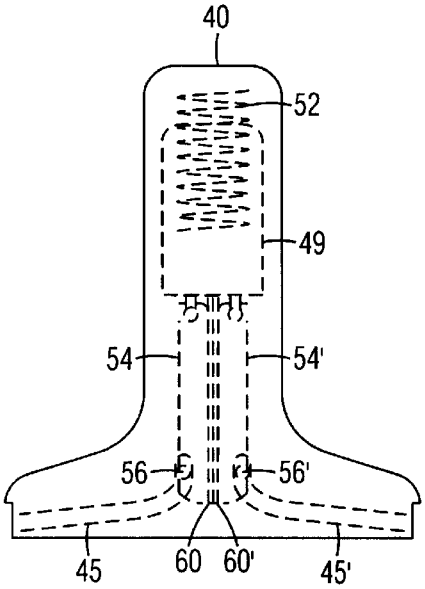
FIG. 6 provides a side view of the device of FIG. 4 with the platens in the fully retracted, wringing position.

During use, any liquid absorbed into pads 60, 60' can be wrung out by pulling retraction bar 49 toward handle 40, as shown in FIG. 6. This action can be conveniently performed with one hand. Springs 52, 52' (one shown) are further compressed. The outer edges of platens 54, 54' are guided toward each other by pins 56, 56' and 58, 58' (not shown) respectively riding along guide rails 45, 45' and 46, 46' (not shown). When retraction bar 49 is fully retracted against handle 40, pins 56, 56' and 58, 58' (not shown) are respectively at the inner ends of guide rails 45, 45' and 46, 46' (not shown), and platens 54, 54' are facing each other. The distance separating the faces of platens 54, 54' is much smaller than the expanded thickness of pads 60, 60', so that pads 60, 60' are tightly compressed to wring out the fluid. Releasing retraction bar 49 allows springs 52, 52' (one shown) to expand and return retraction bar 49, platens 54, 54', and pads 60, 60' to the fully extended position shown in FIG. 5. When pads 60, 60' are worn out, they are preferably replaced by replacing platens 54, 54', which are preferably fixedly attached to pads 60, 60', and removably attached to retraction bar 49.

The invention has been described in terms of the preferred embodiments. One skilled in the art will recognize that it would be possible to construct the elements of the present invention from a variety of materials and to modify the placement of the components in a variety of ways. For example, it would be possible to provide handle 10 with a socket for accepting a pole for converting the hand-held absorbent device for use on a floor. The absorbent device can be used for absorbing paint in the pads, squeezing out excess paint from the pads, and applying the paint to a surface by pressing the pads thereon. The absorbent device can also be used for any other application in which a liquid is either applied to or removed from a working surface. While the preferred embodiments have been described in detail and shown in the accompanying drawings, it will be evident that various further modifications are possible without departing from the scope of the invention as set forth in the following claims.

I claim:

1. A self-wringing absorbent device, comprising:

a rigid handle having a first end and a second end, a first bracket mounted to and extending away from said first end, said first bracket terminating in a first archway, a second bracket mounted to and extending away from said second end, said second bracket terminating in a second archway, said first and second archways positioned so that the first and second archways are aligned;

a movable retraction bar mounted between said first and second brackets for movement towards a first position spaced away from said rigid handle and towards a second position adjacent to said rigid handle;

a platen mounted to and spaced away from said retraction bar, said platen including a hinge which intersects an axis bisecting said first archway and an axis bisecting said second archway, said platen being mounted to said retraction bar along a central portion of said hinge whereby when said retraction bar is in said first position, said platen is substantially flat and whereby when said retraction bar is in said second position, said platen is folded along said hinge and drawn into said archways; and a compressible surface treatment pad mounted to said platen.

2. The self-wringing absorbent device of claim 1 additionally comprising a spring means mounted to said retraction bar for spring biasing said retraction bar in said first position.

3. The self-wringing absorbent device of claim 2 wherein said retraction bar, spring means, and platen are integrally formed.

4. The self-wringing absorbent device of claim 1 additionally including a first slot in said first bracket and a second slot in said second bracket for mounting said retraction bar, each said slot located between said rigid handle and said archway and having a longitudinal central axis which coincides with said axis bisecting said archway.

5. The self-wringing absorbent device of claim 4 wherein said retraction bar includes a first end mounted in said first slot, a second end mounted in said second slot, and a mounting arm having a first end mounted between said first end and said second end, and a second end which extends towards and mounts to said platen hinge.

6. The self-wringing absorbent device of claim 1 wherein said surface treatment pad is mounted to said platen using adhesive.

7. The self-wringing absorbent device of claim 1 wherein said surface treatment pad is mounted to said platen using mechanical means.

8. The self-wringing absorbent device of claim 1 wherein said platen hinge is integrally formed in said platen.

9. The self-wringing absorbent device of claim 1 wherein said spring means comprises a first leaf spring mounted adjacent to an intersection between said first bracket and said retraction bar and a second leaf spring mounted adjacent to an intersection between said second bracket and said retraction bar.

10. The self-wringing absorbent device of claim 9 wherein said first leaf spring and said second leaf spring are integrally formed with said retraction bar.

11. The self-wringing absorbent device of claim 1 wherein said surface treatment pad is constructed from one or more materials selected from the group consisting of: sponge, fabrics, woven and non-woven fibers, fibrous abrasives, steel wool, and chamois.

12. A self-wringing absorbent device comprising:

a rigid handle with a first end and a second end;

a first bracket mounted to said first end of said handle and a second bracket mounted to said second of end of said handle, said first and second brackets extending away from said handle, said first bracket having a first archway at a distal end thereof and a first slot positioned between said handle and a top of said first archway and aligned on an axis which bisects said first archway, said second bracket having a second archway at a distal end thereof and a second slot positioned between said handle and a top of said second archway and aligned-on-an axis which bisects said second archway, said first archway aligned with said second archway and said first slot aligned with said second slot;

a retraction bar having a first end mounted for slidable movement in said first slot, a second end mounted for slidable movement in said second slot, and a mounting arm having an end disposed away from said handle;

a platen divided by a hinge mounted to said end of said mounting arm and oriented so that the hinge is aligned with and centered under said first archway and said second archway;

a compressible pad mounted to said platen; and a spring means associated with said retraction bar for automatically returning said retraction bar to a normal position away from said handle when pressure drawing the retraction bar towards the handle is released.

13. The self-wringing absorbent device of claim 12 wherein said rigid handle, first bracket and second bracket are integrally formed.

14. The self-wringing absorbent device of claim 12 wherein said retraction bar, hinged platen and spring means are integrally formed.

15. The self-wringing absorbent device of claim 12 wherein said spring means comprise leaf springs positioned between said retraction bar and said handle.

16. The self-wringing absorbent device of claim 12 wherein said compressible pad is mounted to said platen using adhesive.

17. The self-wringing absorbent device of claim 16 wherein said compressible pad is mounted to said platen using mechanical fastening means.

18. The self-wringing absorbent device of claim 12 wherein said compressible pad is produced from one or more of the group consisting of: sponges, fabric, woven and non-woven fibers, fibrous adhesives, chamois, and steel wool.

19. A method of rubbing a surface comprising the steps of: providing a self-wringing absorbent device having a rigid handle with a first end and a second end, a first bracket mounted to said first end of said handle and a second bracket mounted to said second of end of said handle, said first and second brackets extending away from said handle, said first bracket having a first archway at a distal end thereof and a first slot positioned between said handle and a top of said first archway and aligned on an axis which bisects said first archway, said second bracket having a second archway at a distal end thereof and a second slot positioned between said handle and a top of said second archway and aligned on an axis which bisects said second archway, said first archway aligned with said second archway and said first slot aligned with said second slot, a retraction bar having a first end mounted for slidable movement in said first slot, a second end mounted for slidable movement in said second slot, and a mounting arm having an end disposed away from said handle, a platen divided by a hinge mounted to said end of said mounting arm and oriented so that the center of said hinge is aligned with and centered under said first archway and said second archway, a compressible pad mounted to said platen, and, a spring means associated with said retraction bar for automatically returning said retraction bar to a normal position away from said handle when pressure drawing the retraction bar towards the handle is released; said method comprising the steps of:

grasping the rigid handle with a palm of a hand;

dipping said compressible pad into a fluid to saturate said compressible pad;

hooking one or more fingertips of said hand around said retraction bar to pull said retraction bar towards said handle, thus drawing said platen towards said handle and causing it to fold along said hinge as said platen is drawn into said archways, thus compressing said compressible pad and expelling excess fluid; and rubbing said surface with said pad.

20. A self-wringing absorbent device, comprising:

a handle;

a pair of brackets extending in a similar direction from opposite ends of said handle;

a pair of guide rails arranged on a distal end of each of said brackets, said pair of guide rails being generally symmetrical about a central axis bisecting said brackets, said guide rails having inner ends close to said central axis, and outer ends extending outwardly away from each other in generally opposite directions;

a retraction bar movably positioned between said brackets;

a pair of platens extending between said brackets and positioned laterally to each other, opposing inner portions of said platens being hinged to said retraction bar, outer portions of each of said platens engaging a corresponding one of said guide rails; and a compressible absorbent pad means attached to outer sides of said platens, when said retraction bar is in an extended position away from said handle, said platens are coplanar with each other, and said absorbent pad means is usable for absorbing a liquid, and when said retraction bar is moved to a retracted position closer to said handle, said outer portions of said platens are guided by said guide rails toward each other until said platens are facing each other, a distance between said outer sides of said platens being substantially less than an uncompressed thickness of said absorbent pad means, so that said absorbent pad means is compressed for wringing out said liquid.

21. The self-wringing absorbent device of claim 20, further including a flared end on each of said brackets, said pair of guide rails being arranged on said flared end.

22. The self-wringing absorbent device of claim 20, further including a spring positioned between said retraction bar and said handle, said spring biasing said retraction bar to said extended position.

23. The self-wringing absorbent device of claim 20, further including a first base connecting corresponding first sides of said flared ends, and a second base connecting corresponding second sides of said flared ends.

* * * * *